US006503080B1

(12) United States Patent
Coudamy

(10) Patent No.: US 6,503,080 B1
(45) Date of Patent: Jan. 7, 2003

(54) BAKING SUPPORT

(75) Inventor: Gérard Coudamy, Limoges (FR)

(73) Assignee: Ceric, Paris (FR)

( * ) Notice: Subject to any disclaimer, the term of this patent is extended or adjusted under 35 U.S.C. 154(b) by 55 days.

(21) Appl. No.: 09/592,866

(22) Filed: Jun. 13, 2000

(30) Foreign Application Priority Data

Jun. 14, 1999 (FR) ..... 99 07476

(51) Int. Cl.[7] ..... F27D 5/00
(52) U.S. Cl. ..... 432/261; 428/116
(58) Field of Search ..... 432/162, 253, 432/258, 259, 261; 156/89.22; 428/116, 118

(56) References Cited

U.S. PATENT DOCUMENTS 3,589,694 A * 6/1971 Gelling et al. ..... 432/261
4,014,968 A 3/1977 Simon
4,174,950 A * 11/1979 Jalbert ..... 432/261
4,416,618 A 11/1983 Smith
4,568,595 A 2/1986 Morris
4,693,918 A 9/1987 Fujimoto et al.
5,406,058 A * 4/1995 Lipp ..... 432/258
5,441,919 A * 8/1995 Park et al. ..... 501/80
5,849,406 A * 12/1998 Daws ..... 428/312.2
6,142,774 A * 11/2000 Brands et al. ..... 432/261
6,254,998 B1 * 7/2001 Tuchinsky ..... 428/567
6,330,904 B2 * 12/2001 Drake et al. ..... 164/35

FOREIGN PATENT DOCUMENTS

DE 2656989 A1 6/1978
EP 0307319 A2 3/1989

* cited by examiner

*Primary Examiner*—Gregory Wilson
(74) *Attorney, Agent, or Firm*—Young & Thompson

(57) ABSTRACT

Products which are to be traversed vertically by a flow of hot gases, such as ceramic supports of honeycomb structure, are supported in an oven by novel structure during baking. The novel structure is a thin horizontal plate of porous ceramic foam. But because this plate of porous ceramic foam is fragile, it is specially supported by a plurality of parallel horizontal bars. These horizontal bars can be of either or both of two types: in one type, the bars are received in grooves on the underside of the porous ceramic foam plate and project below the lower surface of the plate. In another form, the bars pass through bores in the ceramic plate. When both types of bars are used, the bars of one type are perpendicular to the bars of the other type. In all cases, the bars rest on support structure of the oven, so that the plate of porous ceramic foam does not touch this support structure.

6 Claims, 2 Drawing Sheets

BAKING SUPPORT

BACKGROUND OF THE INVENTION

The present application corresponds to French patent application 99.07476 of Jun. 14, 1999, the disclosure of which is incorporated herein by reference.

The present invention has for its object a support adapted to receive products that are to be baked in an oven or dried in a dryer.

This support is particularly adapted for baking ceramic products of the "honeycomb" type as catalyst supports.

These honeycomb elements are generally constituted by parallelepipedal or cylindrical blocks which are traversed from side to side by a multiplicity of channels of square or triangular cross-section which can be less than 1 millimeter with partitions 1 mm to 3/100millimeter thickness.

Because of their small cross-section and their relatively great length (relative to the cross-section), these channel are very difficultly traversed by hot gases from the baking oven and their baking is irregular, which seriously diminishes their quality.

The use of perforated plates does not permit obtaining homogeneous circulation through all the channels, from which arise problems connected to the differences of flow between open or closed channels.

SUMMARY OF THE INVENTION

The present invention has for its object a process providing a solution to this problem.

The process according to the invention consists in placing the catalyst elements to be baked or dried, their channels being vertical, on a parallelepipedal support constituted by a ceramic foam such that the channels of the catalyst element will be in vertical position relative to the support, which has the result that the hot gases pass through the support from side to side and penetrate said channels.

The ceramic foam is a known product which is principally used as a filter in foundry molding: the molten metal is poured onto these filters of ceramic foam, the molten metal passing through this filter and filling the mold.

Work conducted by the applicant has shown that this ceramic foam can perform a totally different function than that for which it was designed.

It is however been discovered that the support of ceramic material should not be too thick, because the loss of pressure to which the hot gas flow passing through it is subject, would be such that the gas flow would not circulate, or at least would circulate poorly within the channels passing through the catalyst support block.

It is therefore necessary that the support be a thin plate, which is to say of a thickness comprised between 1 and 5 centimeters.

But then, as the ceramic foam has a very low resistance to puncturing and flexure, it is necessary to provide means to rigidify it.

According to the invention, these means are constituted by bars carrying the plate of ceramic foam, these bars resting on carrying elements of the oven.

BRIEF DESCRIPTION OF THE DRAWINGS

By way of non-limiting example, and to facilitate an understanding of the invention, there is shown on the accompanying drawings.

DETAILED DESCRIPTION OF THE PREFERRED EMBODIMENTS

Figure 1:
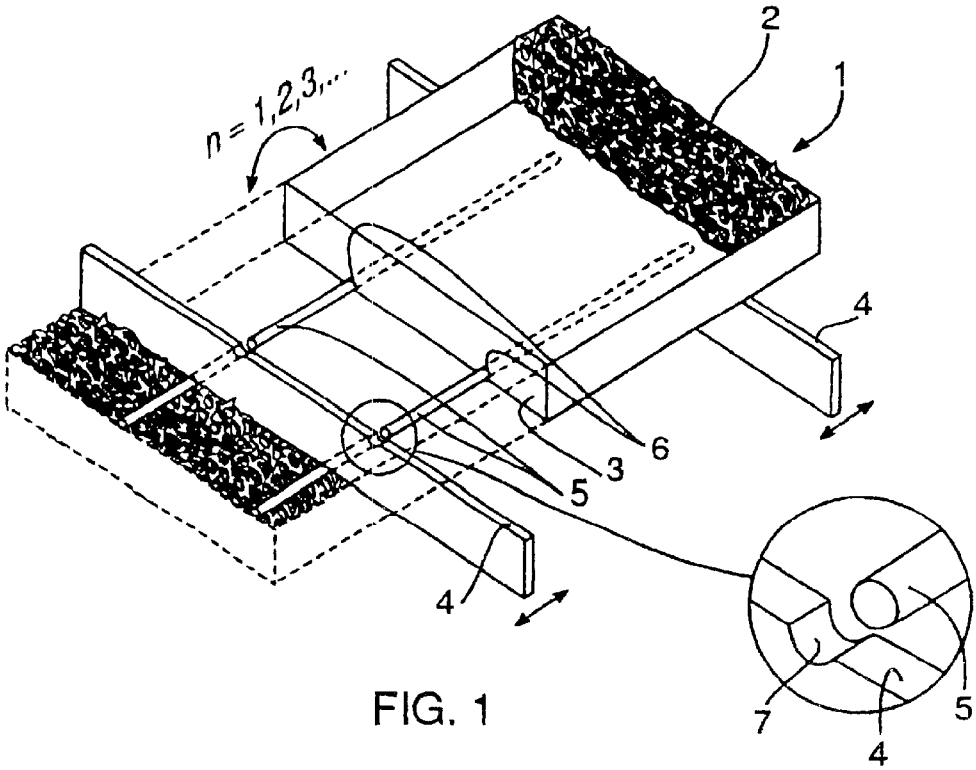
FIG. 1: a schematic perspective view of a first embodiment for the practice of the invention.

Referring to FIG. 1, it will be seen that the device according to the invention is constituted by a plate 1, of small thickness, which is to say comprised between 1.5 and 2.5 centimeters, which is of ceramic foam.

This plate 1 is adapted to serve as a support for one or several catalytic ceramic elements which will be positioned thereon such that the multiple channels which pass through from side to side will be vertical or else perpendicular to the upper surface 2 of the plate 1.

The catalyst support elements, which are not part of the invention, are not shown.

The plate 1 must be carried by carrying elements 4 of the oven (also not shown).

But the plate 1, having only a small resistance to puncturing, cannot be deposited directly on the carrying elements 4. Moreover, having only a small mechanical resistance, it risks being broken between the carrying element such as the elements 4.

To eliminate this drawback, there is provided a plurality of bars 5 (at least two), these bars 5 being parallel to each other and resting on the carrying elements 4.

But upon contact between the lower surface 3 of the plate 1 and the bars 5, the material of which the plate 1 is constituted will not resist puncturing forces.

To eliminate this drawback, there is provided in the lower surface 3 grooves 6 in which the bars 5 are received.

In all the examples shown in FIGS. 1 to 6, the bars 5 are cylindrical and the grooves 6 are semi-cylindrical.

As a result, the bars 5 will project beyond the lower surface 3 of the plate 1 by about half their diameter.

The bars 5 rest on the carrying elements 4.

But as said bars 5 project beyond the lower surface 3 of the plate 1, the ceramic foam does not come into contact with the carrying elements 4.

Thus, there is no puncture phenomenon on the lower surface 3 of the plate 1 and there is no flexural phenomenon of said plate 1.

Preferably, as is shown, the carrying elements 4 comprise notches 7 corresponding to the grooves 6.

Figure 2:
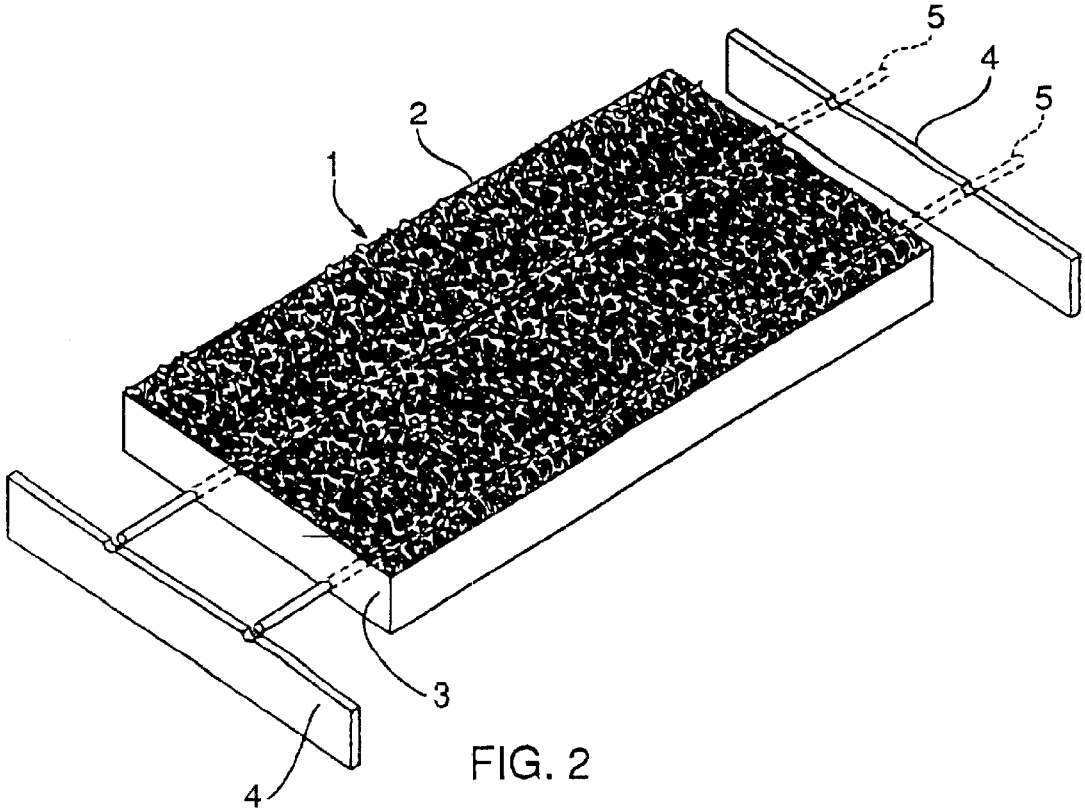
FIG. 2: a schematic perspective view of a second embodiment of practice of the invention.

In FIG. 2, the same elements have the same reference numerals.

The only difference between the example of FIG. 1 arises from the fact that the distance separating the two carrying elements 4 is greater than the length of the plate 1.

Figure 3:
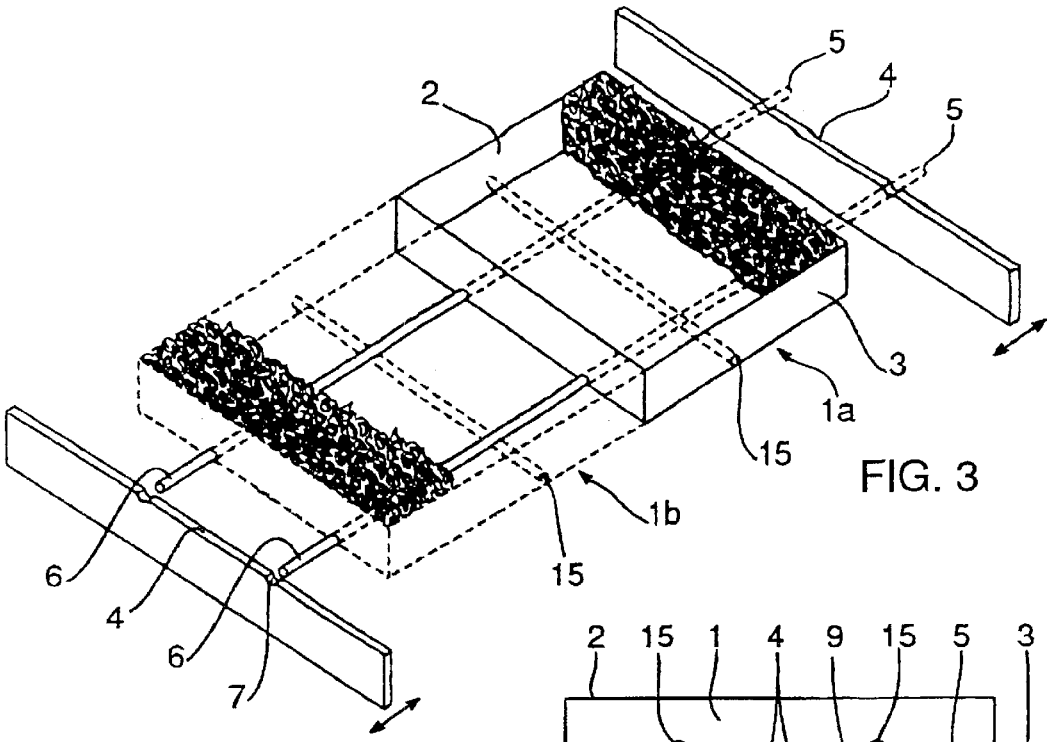
FIG. 3: a schematic perspective view of a third embodiment for the practice of the invention.

Also in FIG. 3, the same elements have the same reference numerals.

In this figure, it is seen that, in addition to the bars 5 which extend over all the length of the plate 1, there are provided complementary bars 15, which are perpendicular to the bars 5.

Although the bars 5 project beyond the lower surface 3 of the plate 1, the complementary bars 15 are disposed within the mass of the plate 1, in bores provided for this purpose.

In FIG. 3 it will also be seen that the plate 1 can be constituted by two portions 1*a* and 1*b* placed side by side on the bars 5.

Figure 4:
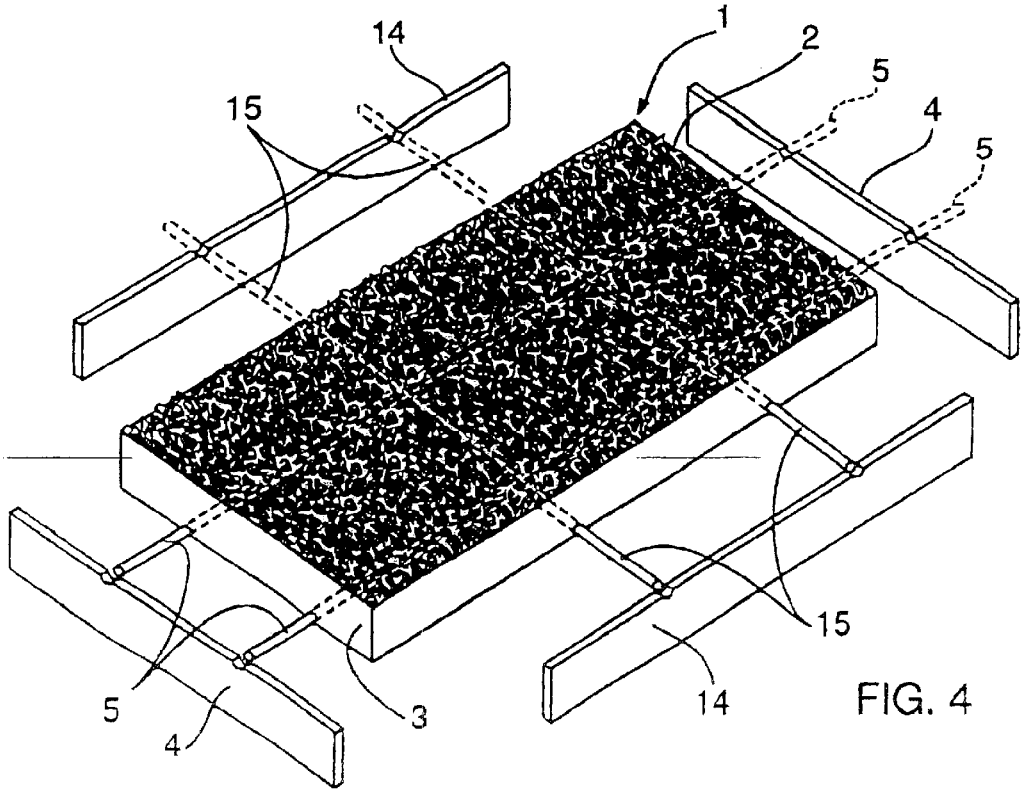
FIG. 4: a schematic perspective view of a fourth example for the practice of the invention.

In FIG. 4, it will be seen that the complementary bars 15 can rest on complementary support elements 14.

Figure 5:
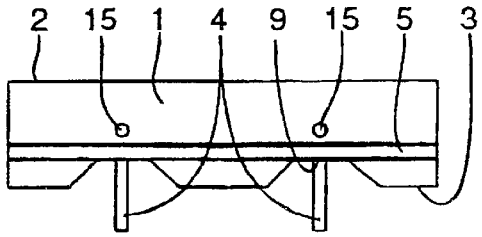
FIG. 5: a schematic view at the beginning of a sixth example of practicing the invention.

In FIG. 5 it will be seen that the bars 5 can, like the additional bars 15, be disposed within the mass of the plate 1. But as it is necessary that the ceramic foam not be in contact with the supports 4, there are provided in the lower surface 3 of the plate 1 grooves 9 which expose the bars 5 such that they come into contact with the carrying elements 4.

The present invention has been described in connection with the baking of catalytic elements, but it is not limited to this particular application; it could advantageously be used for any product which has to be traversed vertically by a flow of hot gases.

On the other hand, it will be seen that certain products to be disposed on the upper surface 2 of the plate 1 will be sufficiently heavy that the rigidification of the plate 1 by the bars 5 or 15 will not be sufficient. The plate 1 of ceramic foam can then be carried by a rigid plate, of ceramic material or the like, provided with a plurality of perforations providing passage to the gas flow, the plate 1 being provided or not with bars 5 and/or 15, this rigid plate being carried by the elements 4.

What is claimed is:

1. A process for supporting in an oven, products which are to be traversed vertically by a flow of hot gas, the process comprising the steps of:

positioning the products on a plate of porous ceramic foam that has recesses therein;

placing the plate on bars that are received in the recesses in order to make the plate rigid; and supporting the bars on carrying elements in the oven.

2. A process as claimed in claim 1, wherein said recesses are provided in a lower surface of said plate of ceramic foam and said bars project below the lower surface of said plate.

3. A process as claimed in claim 1, wherein said bars pass through bores in said plate.

4. A device for supporting products in an oven which are to be traversed vertically by a flow of hot gas, comprising:

a thin plate of ceramic foam; and bars that support said plate, said bars resting on carrying elements of an oven, wherein said bars are disposed in grooves provided in a lower surface of the plate, said bars projecting below said lower surface.

5. A device as claimed in claim 4, in which complementary bars pass through the mass of the porous ceramic foam and are perpendicular to the bars received in grooves in the lower surface of the plate.

6. A device as claimed in claim 5, wherein said complementary bars extend beyond the plate to bear on support elements of the oven.

* * * * *